US006699001B2

(12) United States Patent
Fatemi

(10) Patent No.: US 6,699,001 B2
(45) Date of Patent: Mar. 2, 2004

(54) COUPLER WITH IMPROVED PIN LOCK

(75) Inventor: Ray S. Fatemi, Fairlawn, OH (US)

(73) Assignee: JRB Company, Inc., Akron, OH (US)

( * ) Notice: Subject to any disclaimer, the term of this patent is extended or adjusted under 35 U.S.C. 154(b) by 0 days.

(21) Appl. No.: 10/014,078

(22) Filed: Dec. 11, 2001

(65) Prior Publication Data

US 2002/0071754 A1 Jun. 13, 2002

Related U.S. Application Data

(60) Provisional application No. 60/254,711, filed on Dec. 11, 2000.

(51) Int. Cl.[7] ..... E02F 3/32
(52) U.S. Cl. ..... 414/723; 37/468
(58) Field of Search ..... 414/723; 37/468; 172/272–275

(56) References Cited

FOREIGN PATENT DOCUMENTS

| | | | | |
|---|---|---|---|---|
| GB | 2 330 570 A | * | 4/1999 | ..... 414/723 |
| WO | WO 00/14342 | | 3/2000 | |
| WO | WO 00/14343 | | 3/2000 | |
| WO | WO 01/59222 A1 | | 8/2001 | |

* cited by examiner

*Primary Examiner*—Donald W. Underwood
(74) *Attorney, Agent, or Firm*—Fay, Sharpe, Fagan, Minnich & McKee, LLP

(57) ABSTRACT

A coupler includes a body having first and second recesses that are adapted for respectively receiving first and second associated pins of an associated bucket or other implement. A wedge lock member is movably secured to the body and is movable between a retracted position one or more extended positions. The wedge lock member at least partially obstructs the second recess when it is moved to an extended position so as to capture a second associated pin in the second recess. An actuator is operably coupled to the wedge lock member and is operable to move the wedge lock member between its retracted and extended positions. A supplemental lock arm member is movably secured to the coupler body and is movable between an unlocked position and one or more locked positions. When the supplemental lock arm member is in its locked position, it engages and prevents movement of the lock member from the one or more extended positions to the retracted position. The supplemental lock arm member is movable from its locked position to its unlocked position in response to at least substantial full curling of the coupler body relative to an associated arm to which the coupler body is connected.

18 Claims, 5 Drawing Sheets

COUPLER WITH IMPROVED PIN LOCK

CROSS-REFERENCE TO RELATED APPLICATION

This application claims priority from and hereby expressly incorporates by reference U.S. provisional application No. 60/254,711 filed Dec. 11, 2000.

BACKGROUND OF THE INVENTION

The present invention relates to an improved quick-coupler for attaching a bucket or other implement to an excavator, backhoe, tractor, or other machine or apparatus having a boom/arm/dipper-stick to which a bucket or other implement (e.g., a shear, air-hammer, magnet, etc.) is operatively secured.

Quick-couplers are well-known and in widespread use. One such coupler is sold under the trademark Slide-Loc® by JRB Company, Inc., Akron, Ohio, USA and is shown in FIG. 1. The coupler body 134 is pinned (by pins 137,138) to the distal end 125 of the arm 124 and the distal end 128*b* of the control link 128. The coupler 134, in turn, is adapted for selective and convenient interconnection with an associated implement, such as a bucket, shear, etc. Specifically, the coupler 134 includes first and second recesses 140,150 adapted for respective direct receipt of the first and second implement pins 152,154 without these pins being removed from the associated implement to which they are connected. A wedge lock member 160 is selectively extensible under force of a fluid cylinder 162 (or manually) into the second recess 150 to at least partially obstruct the recess 150 and, thus, capture the second pin 154 therein. To decouple the bucket or other implement from the coupler 134, the wedge lock member 160 must first be retracted to a position where it does not obstruct the mouth of the recess 150. The first recess 140 is formed so that, when the second pin 154 is captured in the second recess 150 by the lock 160, the first pin 152 cannot escape from the first recess 140. This type of quick coupler is highly effective, safe and has enjoyed widespread commercial success.

Couplers such as that shown in FIG. 1 include means for preventing the accidental or inadvertent retraction of the wedge lock member 160 that could result in unintended escape of the second pin 154 from the second recess 150. However, a need has been identified for a new and improved supplemental lock mechanism that does not require an operator to exit the cab of the machine being operated, that is resistant to damage and tampering and that is resistant to operator error.

SUMMARY OF THE INVENTION

In accordance with a first aspect of the present invention, a coupler includes a body having first and second recesses adapted for respectively receiving first and second associated pins of an associated implement. A first lock member is movably secured to the body and is movable between a retracted position one or more extended positions. The first lock member at least partially obstructs the second recess when it is moved to an extended position so as to capture a second associated pin in the second recess. An actuator is operably coupled to the first lock member and is operable to move the first lock member between its retracted and extended positions. A supplemental lock member is movably secured to the coupler body and is movable between an unlocked position and one or more locked positions. When the supplemental lock member is in its locked position, it engages and prevents movement of the first lock member from the extended position to the retracted position. The supplemental lock member is movable from its locked position to its unlocked position in response to movement of said coupler body to a select angular position relative to the associated arm.

In accordance with another aspect of the present invention, a coupler includes a body with first and second pin-receiving recesses. A main lock member is selectively movable between an extended position where the main lock member at least partially obstructs one of the recesses and a retracted position. A supplemental lock member is connected to the body and is movable between a locked position, where the supplemental lock member blocks movement of the main lock member from the extended position to the retracted position, and an unlocked position. The supplemental lock member includes a portion adapted to engage an associated arm to which the body is connected only when the coupler body is at least substantially curled relative to the associated arm. When the coupler body is at least substantially fully curled, the supplement lock member moves from the locked position to the unlocked position.

In accordance with another aspect of the present invention, a coupler includes a body having first and second pin-receiving recesses and that is adapted for pivotable connection to an associated arm. A main lock member is selectively movable to a locked position where it at least partially obstructs one of the recesses to capture an associated pin therein. The coupler further includes means for preventing movement of the main lock member out its locked position unless the body of the coupler is at least substantially fully curled relative to the associated arm.

One advantage of the present invention resides in the provision of a new and improved coupler that is easy to use and that substantially enhances safety and productivity by minimizing the chance for operator error.

Another advantage of the present invention is found in the provision of a coupler that provides an operator with at least one visual indication that the coupler is in a "locked" condition.

A further advantage of the present invention resides in the provision of a coupler with a supplemental pin-lock mechanism that is very robust and resistant to damage and malfunction in harsh environments.

Still another advantage of the present invention is found in the provision of a coupler with improved pin lock wherein an operator need not exit the cab of the excavator or other machine to operate the supplemental lock.

A still further advantage of the present invention resides in the provision of a coupler with improved pin lock wherein a bucket or other implement cannot be de-coupled without the coupler first being at least substantially fully curled relative to the arm to which the coupler is attached.

Another advantage of the present invention resides in the provision of a coupler with improved pin lock wherein electronic proximity sensors are used to provide an operator with information concerning the state of the coupler.

Still other benefits and advantages of the present invention will be apparent to those of ordinary skill in the art to which the invention pertains upon reading and understanding this specification.

BRIEF DESCRIPTION OF THE DRAWINGS

The invention comprises various components and arrangements of components, preferred embodiments of which are illustrated in the accompanying drawings that form a part hereof and wherein.

DETAILED DESCRIPTION OF PREFERRED EMBODIMENTS

A coupler C formed in accordance with the present invention is shown in FIGS. 1A, 1B, 2 and 3. The coupler C is pivotally connected by pin-on arrangement to an associated arm A of and excavator at a pivot point P1 in a conventional manner. The coupler C is also adapted for pivotable connection by pin-on arrangement to a control link member (not shown) or like control member at point P2.

The coupler C defines or otherwise includes a first recess R1 adapted for receipt of a first pin 10 of a bucket or other associated implement and a second recess R2 adapted for receipt of a second pin 12 of the bucket or other associated implement. As is well known, owing to the direction in which the recesses respectively open, the first pin 10 of the associated implement must be inserted into the recess R1 before the second pin 12 of the bucket or other implement is received in the second recess R2.

Figure 1:
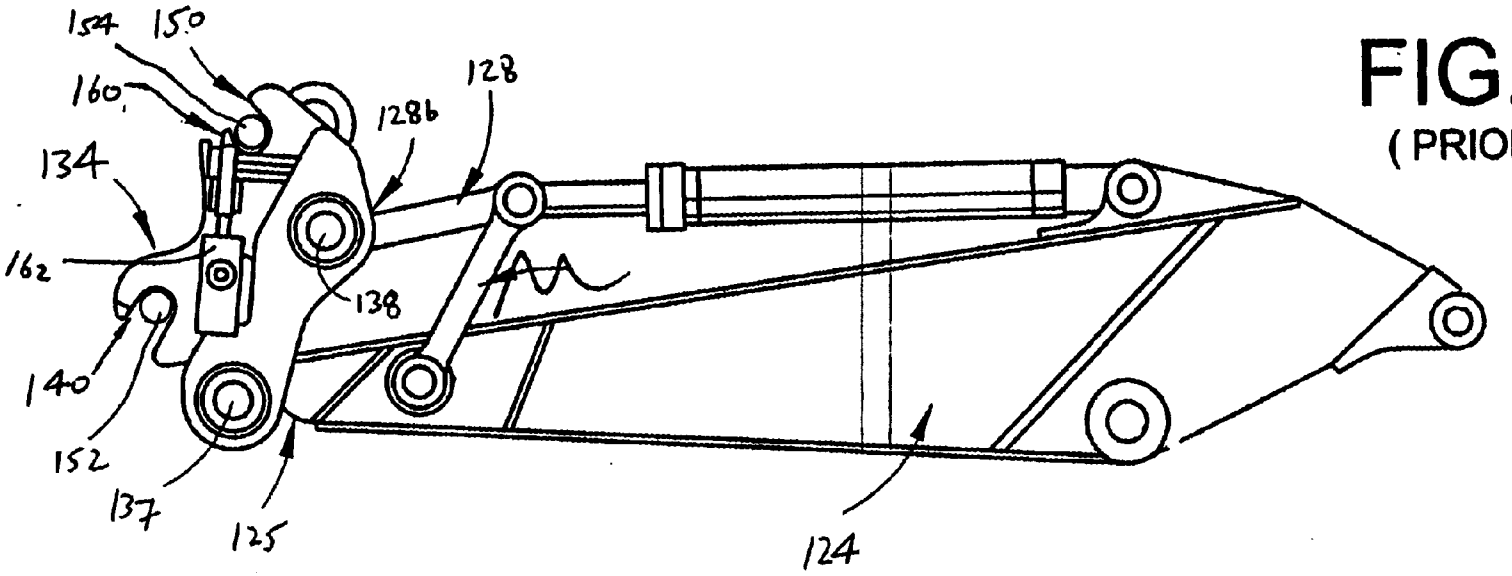
FIG. 1 (PRIOR ART)
FIG. 1 (prior art) illustrates a conventional coupler connected to an associated arm.
Figure 1A:
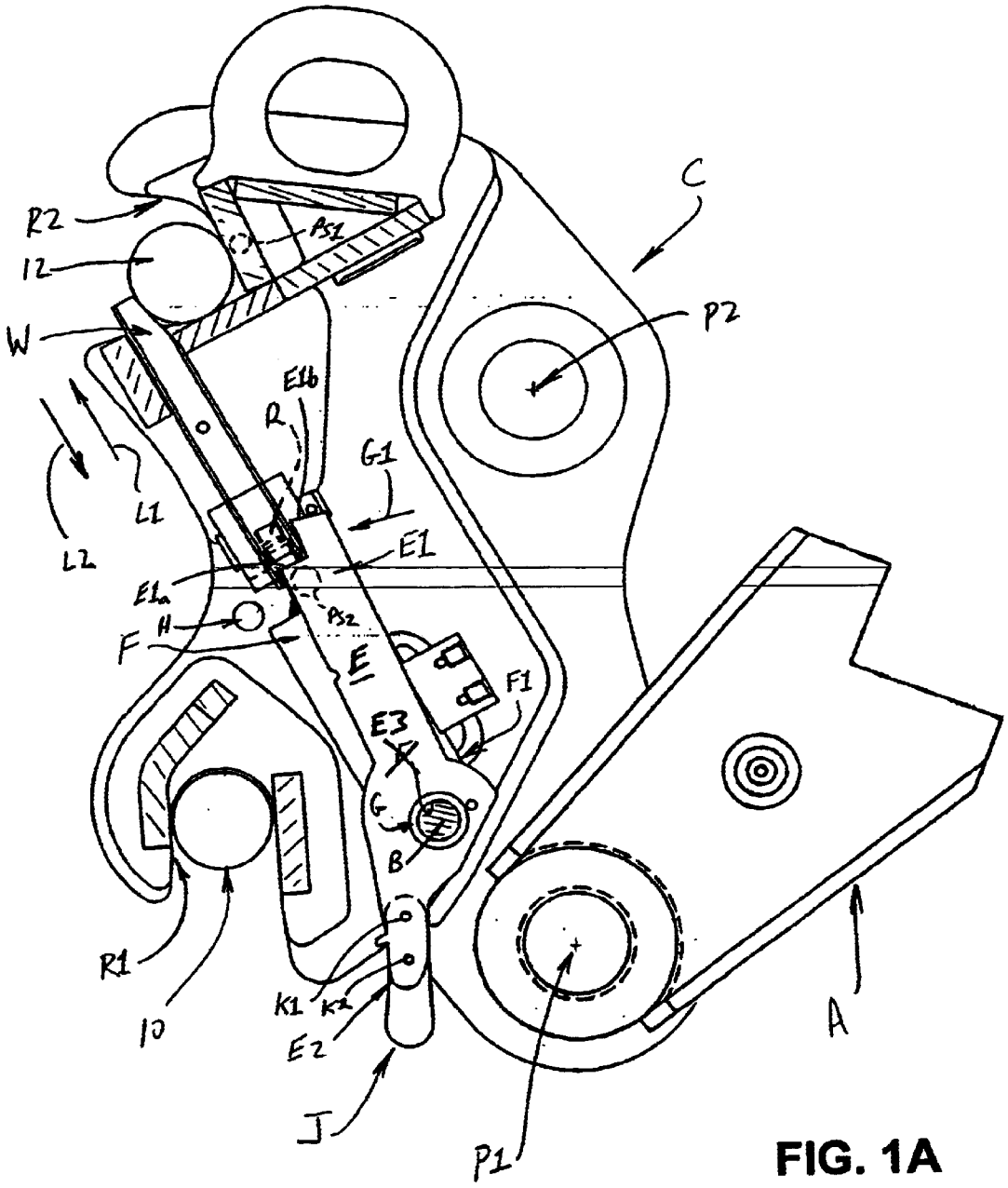
FIG. 1A illustrates a coupler formed in accordance with the present invention in a sectional view taken along line A—A of FIG. 3 and as connected to an associated arm, with the coupler in a first locked condition.
Figure 1B:
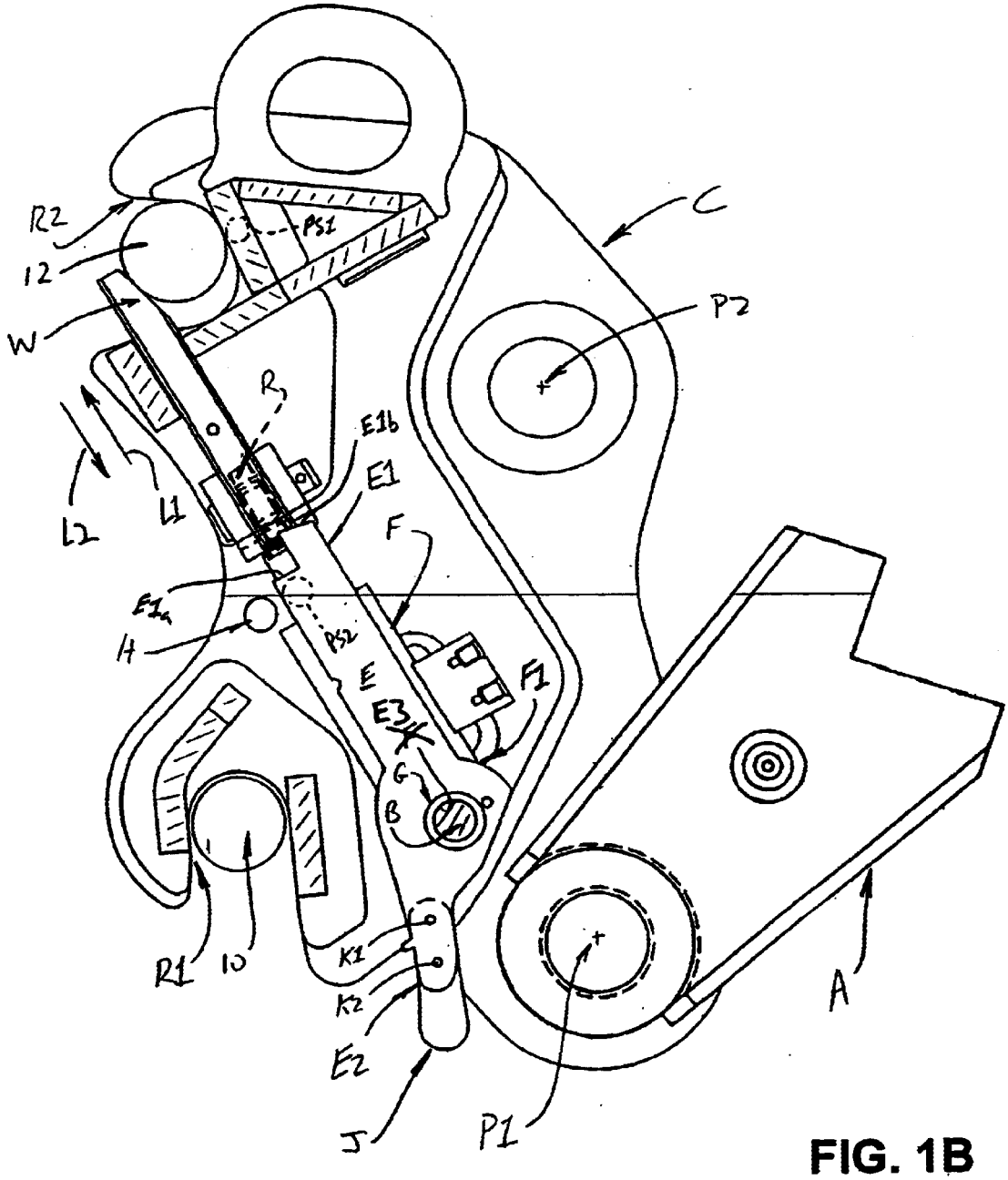
FIG. 1B is similar to FIG. 1A but illustrates the coupler in a second locked condition.
Figure 2:
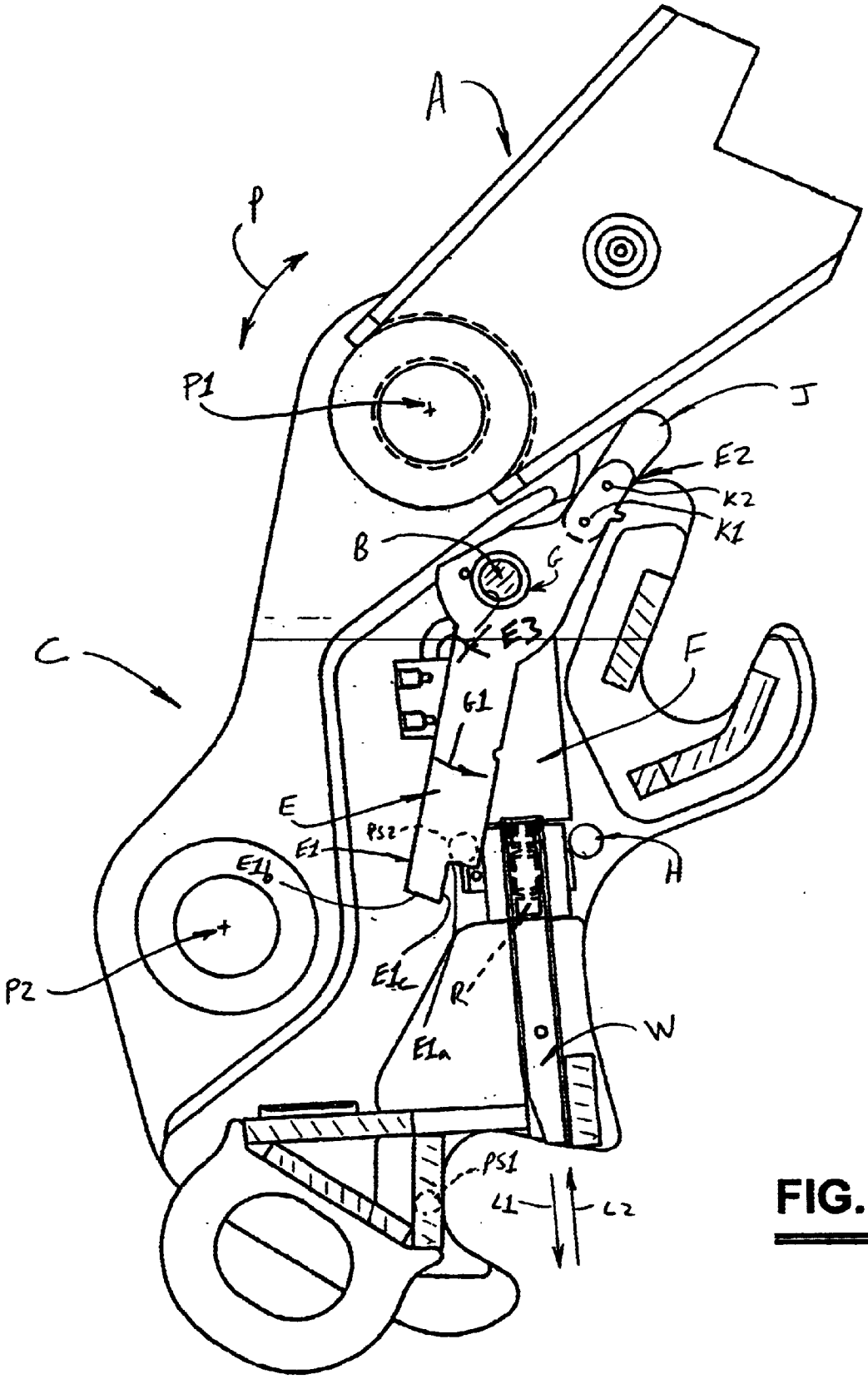
FIG. 2 illustrates the coupler of FIGS. 1A and 1B in an unlocked condition; and, FIG. 3 is a simplified top plan view of a coupler formed in accordance with the present invention.

As with known couplers, the coupler C includes a wedge W or other main or first lock member that is adapted for sliding linear movement as indicated by the arrows L1,L2 between a retracted, unlocked position (FIG. 2) and one or more extended, locked positions (FIGS. 1A and 1B). As illustrated in FIGS. 1A and 1B, when the wedge W is moved to either the first locked position (FIG. 1A) or the second locked position (FIG. 1B), the wedge W is extended in the direction L1 and at least partially obstructs the recess R2 to as shown so as to capture the second pin 12 of the associated bucket or other implement in the recess R2. In the unlocked position as shown in FIG. 2, the wedge W is retracted relative to the recess in a direction L2 (opposite the direction L1) at least an amount sufficient to allow the second pin 12 of the associated bucket or other implement to move freely into and out of the recess R2 for coupling/decoupling operations.

Those of ordinary skill in the art will recognize that the recess R2 is conformed and dimensioned to accommodate multiple pin diameters and centers. The ability of the wedge lock member W to be moved to multiple locked (extended) positions as described ensures that the second pin 12 located in the recess R2 will be tightly held in the recess with significant contact between the outer surface of the pin 12 and the surface defining the recess to increase safety and minimize wear. Furthermore, safety is also enhances because the ability of the recess R2 and wedge lock member W to cooperate and accommodate multiple diameters and centers for the pin 12 helps to ensure that the first pin 10 is fully and tightly seated in the first recess R1 rather than only partially seated therein. Furthermore, as the recess R2, pin 12 and/or wedge lock member W wear, the wedge lock member W can be extended further to ensure that the pin 12 can still be tightly held in the recess R2.

The coupler C comprises means for extending and retracting the wedge W as described. Preferably, a hydraulic or other fluid cylinder or other actuator F is provided for extending and retracting the wedge W, although other structure and/or means such as mechanical and electromechanical (e.g., solenoid) means are contemplated and can be used without departing from the overall scope and intent of the present invention. Also, while the wedge lock member W is slidably movable between its extended or retracted positions, it is not intended that the invention be limited to this arrangement. The illustrated fluid cylinder includes a rod R that extends and retracts and that is operably connected to the wedge W.

Figure 3:
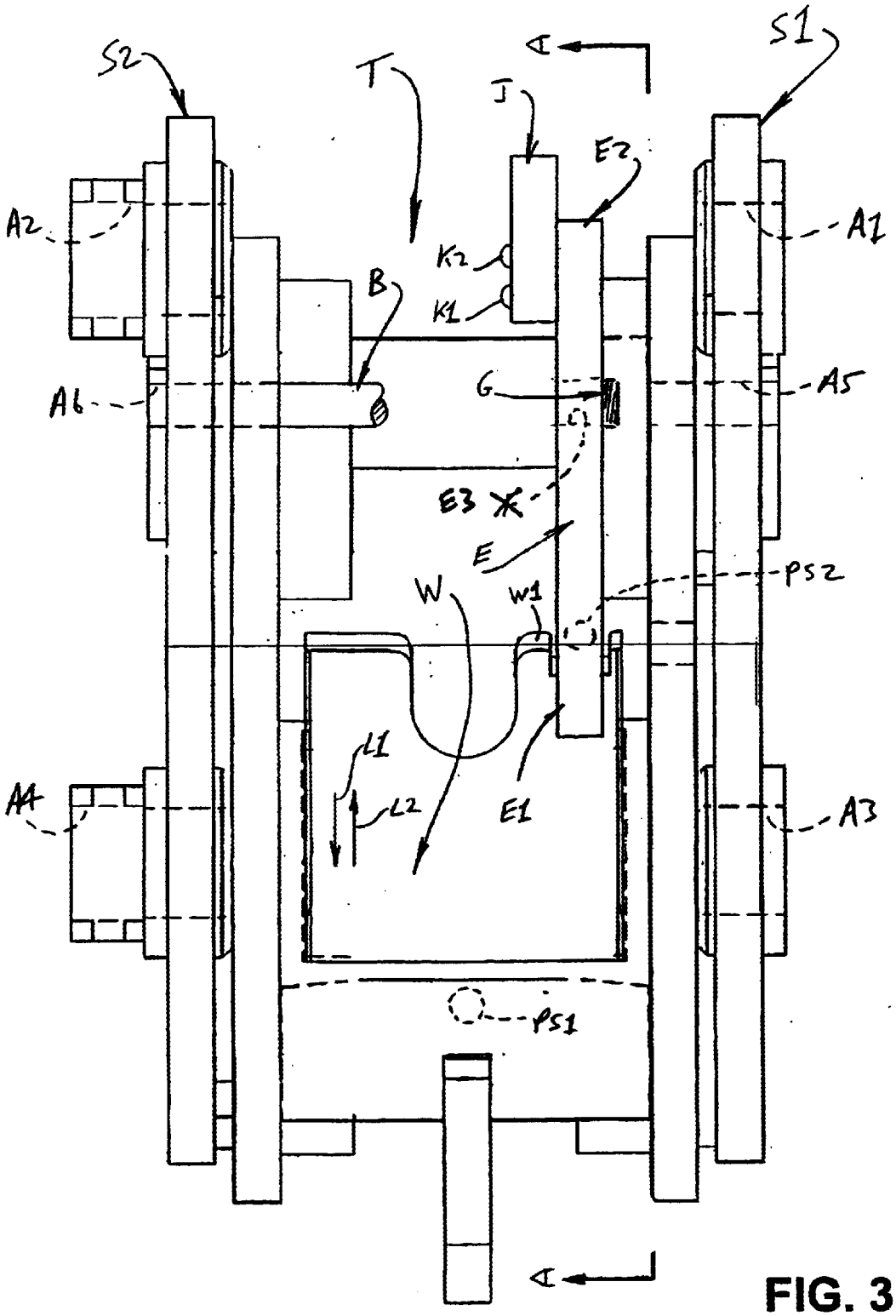

Referring now to FIG. 3, wherein the fluid cylinder F and other components are not shown for clarity, it can be seen that the coupler C comprises a body including first and second parallel, spaced-apart and interconnected sidewalls S1,S2 that define an open channel T therebetween. The pivot points P1,P2 are provided by aligned bores A1,A2 and A3,A4, respectively, defined in the sidewalls S1,S2. Thus, the arm A (FIGS. 1A, 1B and 2) is received in the channel T and connected to the coupler C by a pin-on connection at the bores A1,A2. Likewise, the bucket link or other control link member that is connected at the pivot point P2 is received in the channel T and operatively connected to the coupler by a pin-on connection at the bores A3,A4. A cross-pin B (shown only partially in FIGS. 3 for clarity) or a like member extends between the sidewall S1,S2. In the illustrated embodiment, the cross-pin is received in aligned apertures A5,A6 and is welded or otherwise fixedly secured to the sidewall S1,S2 while spanning the channel T. The fluid cylinder F is preferably fixedly secured to the coupler C by connection of a rear portion F1 thereof (i.e., a portion located opposite the rod R) to the cross-pin B. This arrangement helps to prevent exertion of undesired stresses on the body of the cylinder F as can cause malfunction of the cylinder.

The coupler C further comprises a supplemental lock arm E that is movably secured to the coupler body and adapted for movement between at least one locked position and an unlocked position. With specific reference to the illustrated embodiment, the lock arm E includes aperture E3 defined therethrough, and the arm is secured to the coupler C by passage of the cross-pin B through the aperture E3. Alternatively, a bolt or other fastener or any other suitable arrangement is used to secure the lock arm E movably to the coupler C. The lock arm E is adapted for limited pivotal movement about the cross-pin B between a first locked position (FIG. 1A), a second locked position (FIG. 1B) and an unlocked position (FIG. 2). A torsion spring G or other biasing means normally biases and urges the lock arm E toward the second locked position at all times as indicated by the arrow G1.

The lock arm E includes first and second opposite ends E1,E2. The first end E1 is defined to include first and second stop surfaces E1*a*,E1*b*, wherein the first stop surface E1*a* is recessed relative to the second stop surface E1*b* so that a third stop surface E1*c* (FIG. 2) is also defined. When the wedge lock member W is moved to its first extended position as shown in FIG. 1A, the spring G urges the lock arm E in the direction G1 so that the arm E is held in the first locked position as also shown in FIG. 1A, with the first stop surface E1*a* of the lock arm E in abutment with or adjacent a rear portion W1 (FIG. 3) of the wedge W and the third stop surface E1*c* contacting an the wedge W. When the lock arm E is located in its first locked position as described, the first stop surface E1*a* of the arm prevents movement of the wedge lock member W from the first locked position to the unlocked position (i.e., the stop surface E1*a* of the arm prevents movement of the wedge W in the direction L2 from its first locked position to the retracted position). Similarly, when the wedge lock member W is moved to its second locked position as shown in FIG. 1B, the lock arm E moves in the direction G1 under the force of the spring G to its second locked position wherein the second stop surface E1*b* is in abutment with or adjacent the rear portion W1 of the wedge lock member W. When the lock arm E is so positioned, the stop surface E1*b* prevents movement of the wedge lock member W from its second locked position toward the unlocked position.

The coupler C includes or defines a stop H that prevents movement of the lock arm in the direction G1 beyond the second locked position. Most preferably, this stop H is defined by round stock or otherwise conformed to resist build-up of dirt and debris that could prevent movement of the lock arm E into its first and second locked positions. Also, as shown herein, the wedge lock member W moves over and clears debris off of the stop H each time the wedge lock member W is retracted. It is also most preferred that the first and second stop faces E1*a*,E1*b* of the lock arm E and/or the wedge portion W1 be conformed with sloped faces or otherwise so that contact between the wedge portion W1 and either stop face E1*a*,E1*b* upon attempted movement of the wedge W in the direction L2 results in the lock arm E being urged in the direction G1 (toward the stop H) rather than the opposite direction so as to ensure that wedge W, itself, cannot move the lock arm E from one of its first and second locked positions to its unlocked position.

The lock arm E is selectively movable to its unlocked position in response to pivoting movement of the coupler C relative to the arm A to a select angular position. Preferably, as shown in FIG. 2, pivoting movement of the coupler C on the arc P from its uncurled position (FIGS. 1A, 1B) to its fully or at least substantially fully curled position (FIG. 2) causes the second end E2 of the lock arm E to contact the associated arm A of the excavator or other machine so that the lock arm E is pivoted from either of its first or second locked positions to its unlocked position (FIG. 2) against the force of the spring G. For purposes of this document, the fully curled or at least substantially fully curled position means that the coupler C is pivoted sufficiently so that the first pin 10 of an associated bucket or other implement will not exit the first recess R1 and will be held therein by gravity even if the wedge lock member W is fully retracted and the second pin 12 is able to escape the second recess R2. This position may be obtained, e.g., by full extension of the cylinder to which the control link is operably connected. When the lock arm E is in its unlocked position (FIG. 2), the end E1 thereof is moved away from the rear portion W1 of the wedge W so that the wedge can be retracted freely in the direction L2 from either its first or second locked position to its unlocked position as shown in FIG. 2. When the wedge lock member W is retracted as shown in FIG. 2, the first end E1 of the lock arm E will rest on the wedge W (even if the coupler C is uncurled) until the wedge is once again extended to one of its locked positions, at which time the spring G will move the arm E to its corresponding locked position as described above. Thus, the supplemental lock member E provides means for preventing retraction of the main lock member W unless the coupler body is at least substantially fully curled relative to the associated arm A to which the coupler body is pivotably connected.

As illustrated herein, the second end E2 of the lock arm E preferably includes an adjustable stem J connected thereto by pins, bolts, screws or other fasteners K1,K2 and that contacts the associated arm A. The stem J can be used to extend the length of the arm E and/or the angle between the stem J and the arm E can be adjusted to vary the contact position of the stem J with the associated arm A to facilitate the coupler being used in connection with arms A of different dimensions and shapes.

When the coupler C is operably coupled to an arm A of an associated excavator or other machine, the second end E2 of the lock arm, with or without the stem J, provides a visual indicator to an operator of the machine concerning the position of the lock arm E. In particular, when the lock arm E is located in its unlocked position, it is located closely adjacent the body of the coupler C in the region of the first recess R1. This location of the second end E2 of the lock arm will be readily apparent to an operator and will notify the operator that the lock arm E has not moved into one of its locked positions under the force of the spring G as intended due to the presence of dirt or debris or some malfunction. On the other hand, as shown in FIGS. 1A and 1B, when the lock arm E is located in one of its locked positions, the second end E2 thereof is spaced from the region of the coupler body defining the recess R1. Accordingly, the visual indicator provided by the second end E2 of the arm E (and the stem J if present) minimizes the chance that an operator will operate the bucket or other implement connected to the coupler when the lock arm is not in one of its locked positions. The second end E2 of the arm and the stem J are preferably painted with bright, highly visible colors (e.g., red, pink, etc.) that contrast with the color of the arm A and the coupler body to increase visibility.

Furthermore, it should be noted that the lock arm E is intended to provide a supplemental lock function only and is not intended to be the only lock or the primary lock used to hold the wedge lock member W in position. Thus, in the event the cylinder F or other actuator means for moving/holding the wedge lock member W to/in one of its extended positions is malfunctioning, the coupler C should not be used with only the supplemental lock arm E inhibiting movement of the wedge to its retracted position.

It is most preferred that the coupler C include a first proximity sensor PS1 connected thereto and adapted to sense the presence of the second pin of the bucket or other implement when the second pin is fully seated in the second recess R2. The proximity sensor is electrically connected to an indicator light and/or buzzer located in he cab of the excavator. Upon the second pin being fully seated in the recess R2, the operator is notified by the light and/or buzzer. This prevents the operator from extending the wedge W to obstruct the recess R2 until the second pin of the bucket or other implement is fully received in the recess R2.

It is preferred that a second proximity sensor PS2 be provided as a part of the coupler C. Specifically, it is preferred that the second proximity sensor PS2 be connected to the lock arm E or the stop H and sense contact or adjacency of the lock arm E with the stop H. Here, again, the proximity sensor PS2 is electrically connected to an indicator light and/or buzzer in the operator can and the light and/or buzzer is operated when the arm E contacts the stop H. In this manner, the operator can be certain that the lock arm E has moved to its first or second locked position under the force of the spring G and was not prevented from doing so by dirt, debris, or malfunction.

The invention has been described with reference to preferred embodiments. Modifications and alterations will occur to those of ordinary skill in the art to which the invention pertains. It is intended that the invention be construed as encompassing all such modifications and alterations insofar as they fall within the scope of the following claims as construed literally and/or according to the doctrine of equivalents.

Having thus described the preferred embodiments, what is claimed is:

1. A coupler comprising:

a body including first and second recesses adapted for respectively receiving first and second associated pins of an associated implement;

a first lock member movably secured to said body and movable between a retracted position and at least one extended positions said first lock member at least partially obstructing said second recess when moved to said at least one extended position so as to capture a second associated pin in said second recess;

an actuator operably coupled to said first lock member and operable to move said first lock member to and between said retracted position and said at least one extended position; and, a supplemental lock movably secured to said coupler body and movable between an unlocked position and at least one locked position, said supplemental lock, when located in said at least one locked position, engaging and preventing movement of said first lock member from said at least one extended position to said retracted position, said supplemental lock movable from said at least one locked position to said unlocked position in response to contact of a portion of said supplemental lock with an associated arm to which said coupler is adapted to be pivotably connected upon movement of said coupler body to a select angular position relative to the associated arm.

2. The coupler as set forth in claim 1, wherein said select angular position is an at least substantially fully curled position relative to the associated arm.

3. The coupler as set forth in claim 1, further comprising:

a spring engaged with said supplemental lock and biasing said supplemental lock to said at least one locked position.

4. The coupler as set forth in claim 1, wherein said actuator comprises one of a manual actuator, a fluid-cylinder actuator and a solenoid actuator.

5. The coupler as set forth in claim 1, wherein said supplemental lock comprises a member that is pivotably secured to said body and adapted for pivoting movement between first and second positions when said supplemental lock moves between said at least one locked position and said unlocked position.

6. The coupler as set forth in claim 5, wherein said first lock member is slidably secured to said body and moves linearly between said retracted position and said at least one extended position.

7. The coupler as set forth in claim 6, wherein said first lock member moves between said retracted position and at least first and second extended positions, and wherein said supplemental lock comprises a first stop surface that prevents movement of said first lock member from said first extended position to said retracted position and a second stop surface that prevents movement of said first lock member from said second extended position to said retracted position.

8. The coupler as set forth in claim 2, wherein said supplemental lock comprises: (i) a first portion that engages said first lock member when said supplemental lock is located in said at least one locked position; and, (ii) a second portion that projects outwardly from said body and engages the associated arm when said coupler body is located in said select angular position.

9. The coupler as set forth in claim 8, further comprising:

a stem adjustably connected to said second portion of said supplemental lock and adapted for being positioned and secured in different positions relative to said second end of said supplemental lock.

10. The coupler as set forth in claim 8, wherein a location of said second portion of said supplemental lock relative to said body provides a visual indication of said supplemental lock being in said at least one locked position.

11. The coupler as set forth in claim 1, further comprising:

a first proximity sensor located adjacent said second recess to sense a presence of the second associated pin in the second recess.

12. The coupler as set forth in claim 1, further comprising:

a proximity sensor for sensing a presence of said supplemental lock in said at least one locked position.

13. The coupler as set forth in claim 5, wherein said body comprises first and second sidewalls defining a channel therebetween, said coupler further comprising a cross-pin that extends between said first and second sidewalls through said channel, wherein said pivotable member of said supplemental lock is pivotably connected to said cross-pin.

14. A coupler comprising:

a body including first and second pin-receiving recesses;

a main lock member selectively movable between an extended position where said main lock member at least partially obstructs one of said recesses and a retracted position;

a supplemental lock member connected to said body and movable between a locked position, where said supplemental lock member blocks movement of said main lock member from said extended position to said retracted position, and an unlocked position, said supplemental lock member including a portion adapted to engage an associated arm to which said body is connected only when said body is at least substantially curled relative to the associated arm whereby said supplemental lock member moves from said locked position to said unlocked position when said body is at least substantially fully curled relative to the associated arm.

15. The coupler as set forth in claim 14, wherein said supplemental lock member is pivotably secured to said body.

16. The coupler as set forth in claim 14, wherein said supplement lock member comprises a portion that provides a visual indicator to an observer if said supplement lock member is in said unlocked position.

17. The coupler as set forth in claim 14, wherein said supplemental lock member is spring-biased into said locked position.

18. A coupler comprising:

a body including first and second pin-receiving recesses and adapted for pivotable connection to an associated machine arm;

a main lock member selectively movable to a locked position where said main lock member at least partially obstructs one of said recesses to capture an associated pin therein; and, means for preventing movement of said main lock member out of said locked position unless said body is at least substantially fully curled relative to the associated machine arm, said means for preventing movement of said main lock member comprising a supplemental lock arm that projects outwardly from said body and that is adapted to engage the associated machine arm when said body is at least substantially fully curled relative to the associated machine arm.

* * * * *

UNITED STATES PATENT AND TRADEMARK OFFICE

CERTIFICATE OF CORRECTION

PATENT NO. : 6,699,001 B2
DATED : March 2, 2004
INVENTOR(S) : Ray S. Fatemi

It is certified that error appears in the above-identified patent and that said Letters Patent is hereby corrected as shown below:

Title page,
Replace drawing with the following:

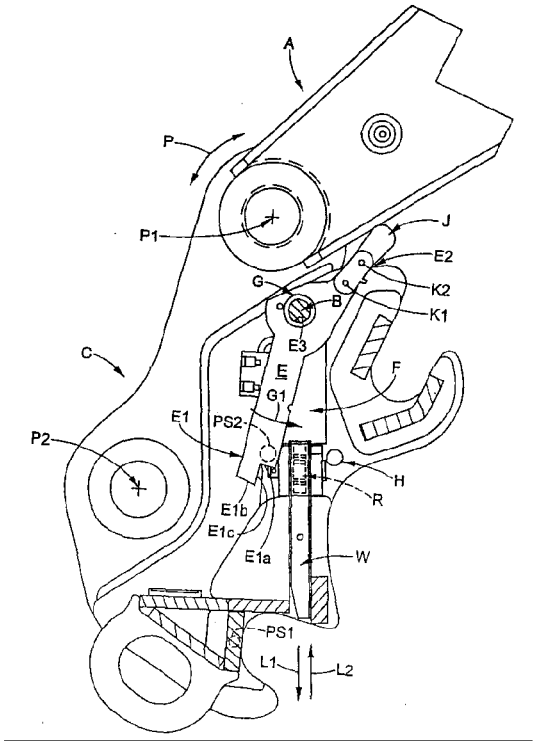

UNITED STATES PATENT AND TRADEMARK OFFICE

CERTIFICATE OF CORRECTION

PATENT NO. : 6,699,001 B2
DATED : March 2, 2004
INVENTOR(S) : Ray S. Fatemi

It is certified that error appears in the above-identified patent and that said Letters Patent is hereby corrected as shown below:

Drawings,

Replace Fig. 1 with the following:

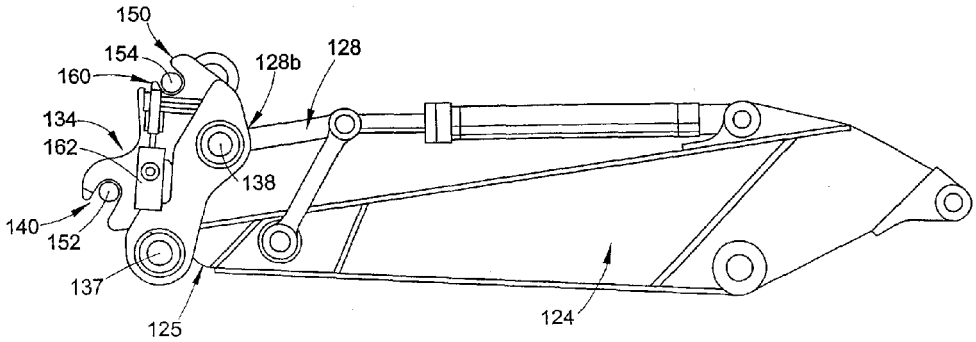

FIG. 1
(PRIOR ART)

UNITED STATES PATENT AND TRADEMARK OFFICE

CERTIFICATE OF CORRECTION

PATENT NO. : 6,699,001 B2
DATED : March 2, 2004
INVENTOR(S) : Ray S. Fatemi

It is certified that error appears in the above-identified patent and that said Letters Patent is hereby corrected as shown below:

Drawings (cont'd),
Replace Fig. 1A with the following:

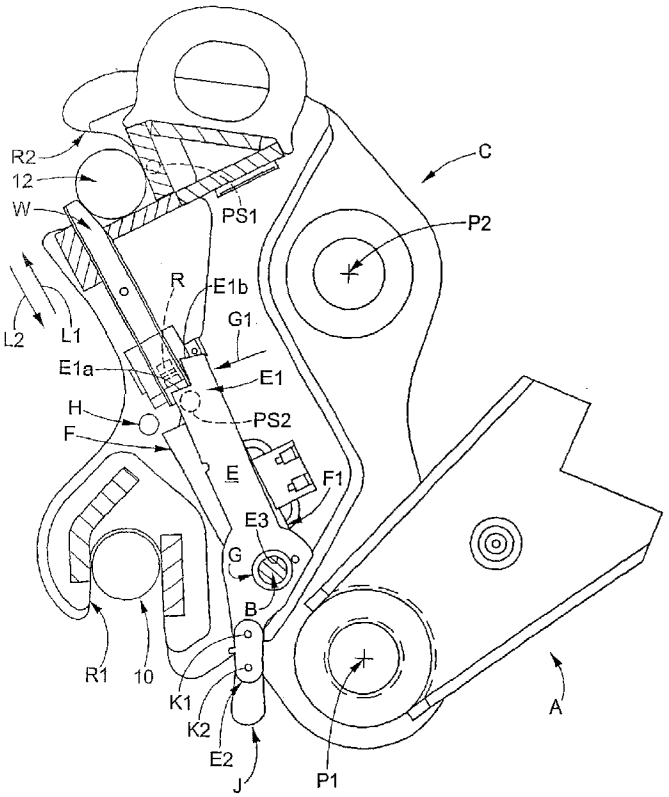

FIG. 1A

UNITED STATES PATENT AND TRADEMARK OFFICE

CERTIFICATE OF CORRECTION

PATENT NO. : 6,699,001 B2
DATED : March 2, 2004
INVENTOR(S) : Ray S. Fatemi

It is certified that error appears in the above-identified patent and that said Letters Patent is hereby corrected as shown below:

Drawings (cont'd),
Replace Fig. 1B with the following:

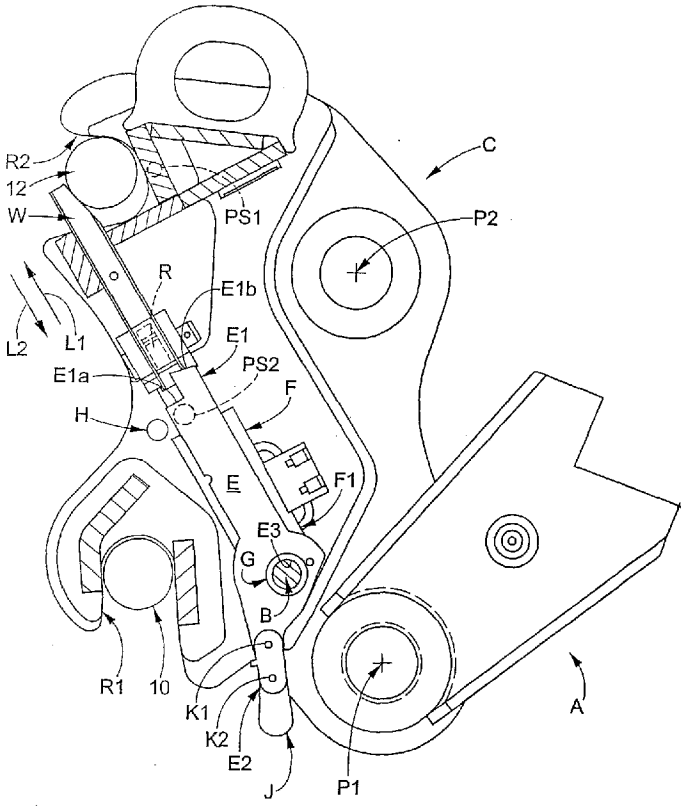

FIG. 1B

UNITED STATES PATENT AND TRADEMARK OFFICE

CERTIFICATE OF CORRECTION

PATENT NO. : 6,699,001 B2
DATED : March 2, 2004
INVENTOR(S) : Ray S. Fatemi

It is certified that error appears in the above-identified patent and that said Letters Patent is hereby corrected as shown below:

Drawings (cont'd),
Replace Fig. 2 with the following:

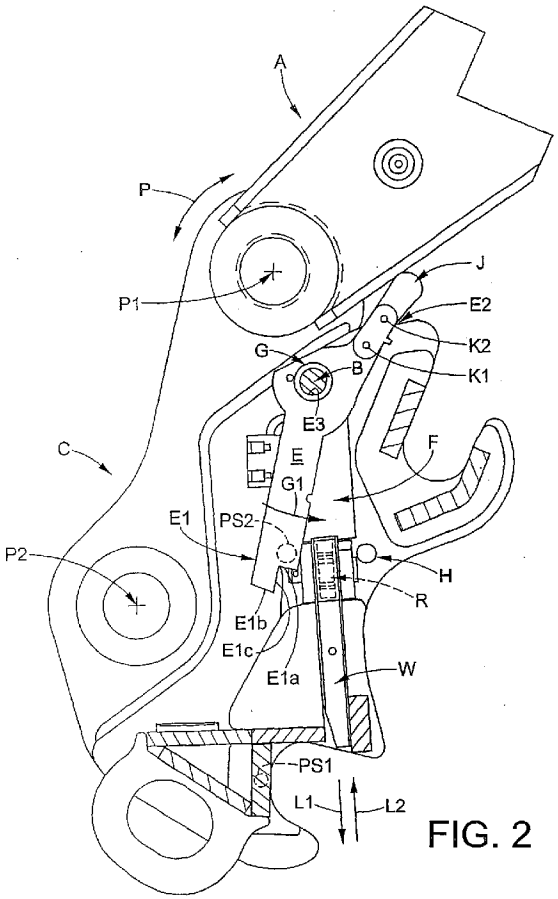

FIG. 2

UNITED STATES PATENT AND TRADEMARK OFFICE

CERTIFICATE OF CORRECTION

PATENT NO. : 6,699,001 B2
DATED : March 2, 2004
INVENTOR(S) : Ray S. Fatemi

It is certified that error appears in the above-identified patent and that said Letters Patent is hereby corrected as shown below:

Drawings (cont'd),
Replace Fig. 3 with the following:

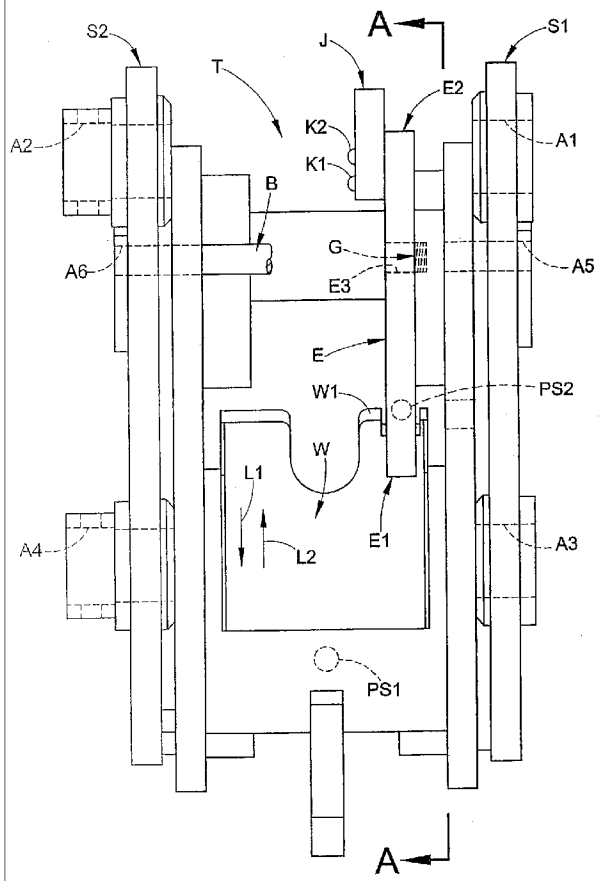

FIG. 3

Signed and Sealed this

Seventeenth Day of August, 2004

JON W. DUDAS
*Acting Director of the United States Patent and Trademark Office*